US010378723B2

(12) United States Patent
Dubuc et al.

(10) Patent No.: US 10,378,723 B2
(45) Date of Patent: Aug. 13, 2019

(54) MOTOR VEHICLE LIGHT-EMITTING OPTICAL MODULE

(71) Applicant: VALEO VISION, Bobigny (FR)

(72) Inventors: Cyril Dubuc, Bobigny (FR); Pascal Garin, Bobigny (FR); Fabrice Egal, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/715,970

(22) Filed: Sep. 26, 2017

(65) Prior Publication Data

US 2018/0087730 A1 Mar. 29, 2018

(30) Foreign Application Priority Data

Sep. 26, 2016 (FR) ..... 16 59049

(51) Int. Cl.
*F21S 41/19* (2018.01)
*F21S 41/29* (2018.01)
(Continued)

(52) U.S. Cl.
CPC ..... *F21S 45/49* (2018.01); *F21S 41/147* (2018.01); *F21S 41/192* (2018.01); *F21S 41/24* (2018.01); *F21S 41/29* (2018.01); *F21S 41/321* (2018.01); *F21S 41/39* (2018.01); *F21S 41/663* (2018.01); *F21S 45/10* (2018.01); *F21S 45/47* (2018.01); *F21V 21/088* (2013.01)

(58) Field of Classification Search
CPC . F21S 41/20; F21S 41/30; F21S 43/20; F21V 5/00; F21V 7/00
USPC ..... 362/509, 510, 512, 459
See application file for complete search history.

(56) References Cited

U.S. PATENT DOCUMENTS

2011/0211361 A1 9/2011 Kawamura
2012/0002434 A1* 1/2012 Rajon ..... B60J 5/107 362/544

(Continued)

FOREIGN PATENT DOCUMENTS

EP 2 366 938 A1 9/2011
EP 2 966 342 A1 1/2016

(Continued)

OTHER PUBLICATIONS

French Preliminary Search Report dated Feb. 17, 2017 in French Application 16 59049, filed on Sep. 26, 2016 (with English Translation of Categories of cited documents).

*Primary Examiner* — Edwyn Labaze
(74) *Attorney, Agent, or Firm* — Oblon, McClelland, Maier & Neustadt, L.L.P.

(57) ABSTRACT

The invention proposes a motor vehicle optical module for emitting at least two light-emitting segments that can be activated selectively. The module includes a substrate and at least two light sources mounted on the substrate, each of which can be activated selectively to emit light rays. Primary optical means are adapted to form primary light beams from the light rays emitted by each light source. A secondary optical means is adapted to project each of the primary light beams to form the light-emitting segments, wherein optical means includes a single support that carries the substrate, the primary optical means and the secondary optical means, and in that it includes means for positioning the primary optical means relative to the substrate.

15 Claims, 7 Drawing Sheets

(51) Int. Cl.

| | |
|---|---|
| ***F21S 41/39*** | (2018.01) |
| ***F21S 45/49*** | (2018.01) |
| ***F21V 21/088*** | (2006.01) |
| ***F21S 41/147*** | (2018.01) |
| ***F21S 41/24*** | (2018.01) |
| ***F21S 41/32*** | (2018.01) |
| ***F21S 41/663*** | (2018.01) |
| ***F21S 45/10*** | (2018.01) |
| ***F21S 45/47*** | (2018.01) |

(56) References Cited

U.S. PATENT DOCUMENTS

| | | | | |
|---|---|---|---|---|
| 2014/0169014 | A1* | 6/2014 | Jungwirth | F21S 48/1154 362/509 |
| 2014/0226355 | A1 | 8/2014 | Blandin et al. | |
| 2015/0266529 | A1* | 9/2015 | Criaud | B60Q 1/045 29/897.2 |
| 2015/0377439 | A1 | 12/2015 | Madelaine et al. | |
| 2016/0259116 | A1* | 9/2016 | Van Bommel | G02B 6/0003 |
| 2016/0298818 | A1* | 10/2016 | Duarte | H05K 1/0203 |
| 2018/0023777 | A1* | 1/2018 | Roucoules | F21V 29/59 362/508 |
| 2018/0180241 | A1* | 6/2018 | Huber | F21S 41/25 |
| 2018/0238512 | A1* | 8/2018 | Courcier | B60Q 1/085 |

FOREIGN PATENT DOCUMENTS

| | | |
|---|---|---|
| FR | 2 979 971 | 3/2013 |
| WO | WO 2013/037799 A1 | 3/2013 |

* cited by examiner

Fig. 2
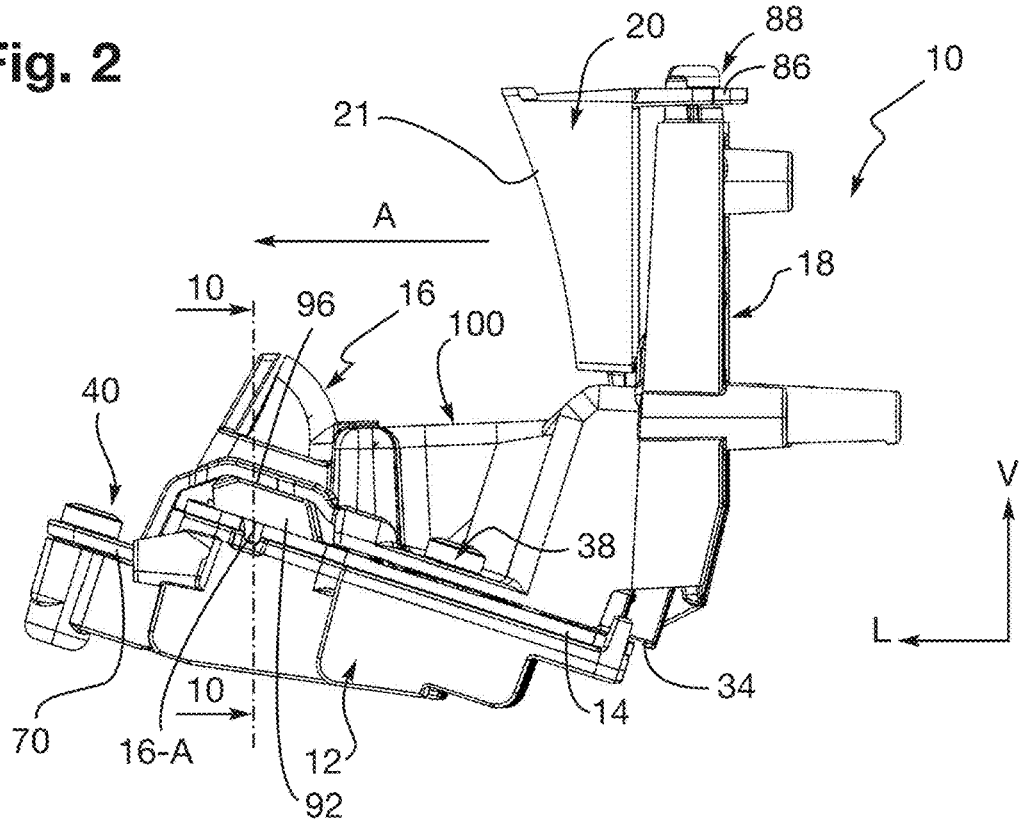
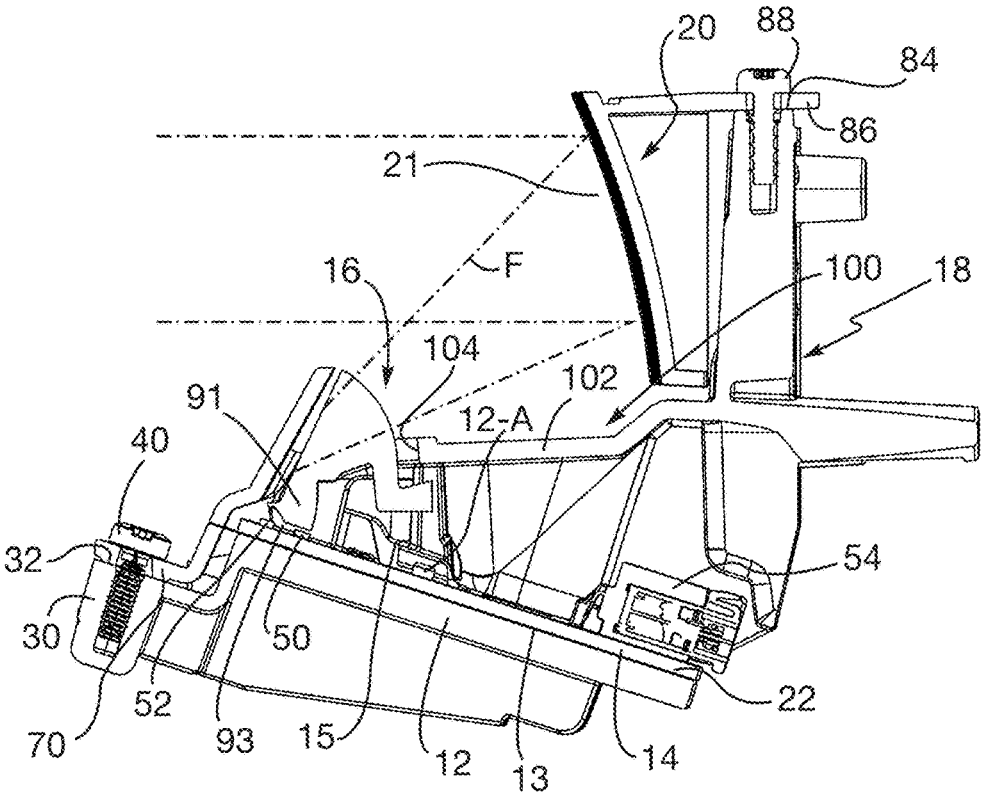
Fig. 3

MOTOR VEHICLE LIGHT-EMITTING OPTICAL MODULE

TECHNICAL FIELD OF THE INVENTION

The invention concerns a motor vehicle optical module, also known as a light-emitting module or lighting module.

The invention more particularly concerns an optical module designed to emit at least two light-emitting segments that can be activated selectively for example for the production of a headlamp or headlight including at least one such optical module.

TECHNICAL BACKGROUND OF THE INVENTION

According to a known general design, for example that from the document WO-A1-2016/005409, a light-emitting module of this kind includes a substrate, at least two light sources mounted on the substrate each of which can be activated selectively to emit light rays, primary optical means adapted to form primary light beams from the light rays emitted by each light source, and secondary optical means adapted to project each of the primary light beams to form said light-emitting segments.

For example, the primary optical means take the form of a one-piece primary optical element such as a collector or lens that must be positioned accurately relative to the light sources so that the light rays emitted by each light source enter a light guide that is part of the primary optical element.

For example, the secondary optical means take the form of a reflector element, for example a convergent mirror, that must also be positioned accurately, notably relative to the primary optical element.

Examples of optical modules of the above kind are shown in the documents FR-A-2.979.971 and FR-A-2.964.724.

The invention aims to propose a design of an optical module of the above kind that makes it possible to solve the problems referred to above relating to the necessity to position accurately the various optical components.

SUMMARY OF THE INVENTION

The invention proposes a motor vehicle optical module for emitting at least two light-emitting segments that can be activated selectively, the module including:

a substrate;

at least two light sources mounted on the substrate each of which can be activated selectively to emit light rays;

primary optical means adapted to form primary light beams from the light rays emitted by each light source;

secondary optical means adapted to project each of the primary light beams to form said light-emitting segments, characterized in that it includes a single support that carries the substrate, the primary optical means and the secondary optical means, and in that it includes means for positioning the primary optical means relative to the substrate.

According to other features of the module:

the primary optical means:

include position indexing means that cooperate with complementary means of the substrate;

are fixed in their indexed position by clamping them between the support and the substrate;

the secondary optical means:

include position indexing means that cooperate with complementary means of the support;

are fixed to the support;

the optical module includes a cooling block that is adjacent the substrate;

the cooling block includes position indexing means that cooperate with complementary means of the substrate;

the substrate is fixed by clamping it between the cooling block and the support;

the support is fixed to the cooling block by means of clamping screws;

the substrate is a horizontal plate that is disposed vertically between an upper face of the cooling block and a lower bearing plane on the support;

the support includes:

at least two lower bearing areas delimiting said lower bearing plane on the upper face of the substrate, and an elastically deformable lug that is fixed to the cooling block to clamp the primary optical means between the support and the substrate;

the primary optical means include:

a lower bearing face that cooperates with the upper face of the substrate;

and at least one upper clamping face on which said elastically deformable lug of the support acts.

BRIEF DESCRIPTION OF THE FIGURES

Other features and advantages of the invention will become apparent on reading the following detailed description for an explanation of which reference will be made to the appended drawings, in which:

FIG. 2 is a side view of the optical module shown in FIG. 1;

FIG. 3 is a view analogous to that of FIG. 2 in which the various components are shown in section on a longitudinal and vertical median plane;

DETAILED DESCRIPTION OF THE FIGURES

Figure 1:
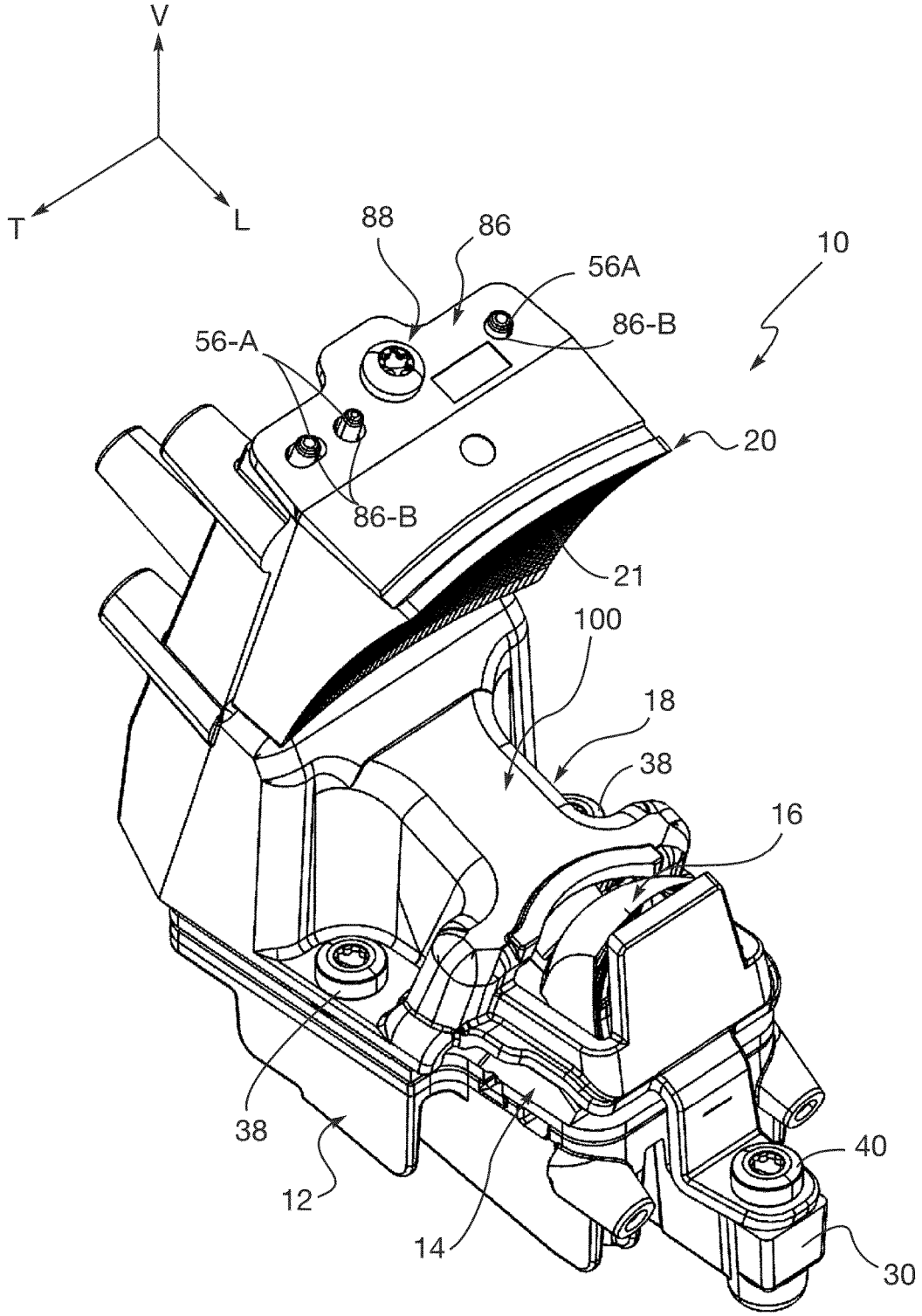
FIG. 1 is a perspective view of one embodiment of an optical module according to the invention.
Figure 4:
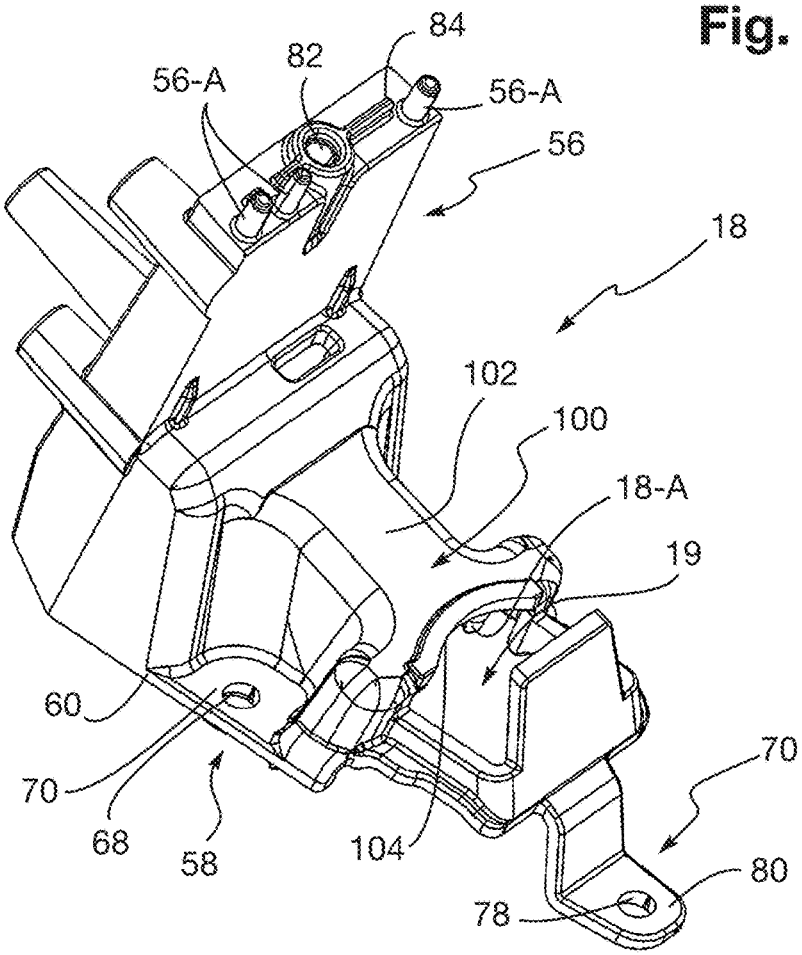
FIG. 4 is a perspective view of the single support of the optical module shown in FIG. 1.
Figure 5:
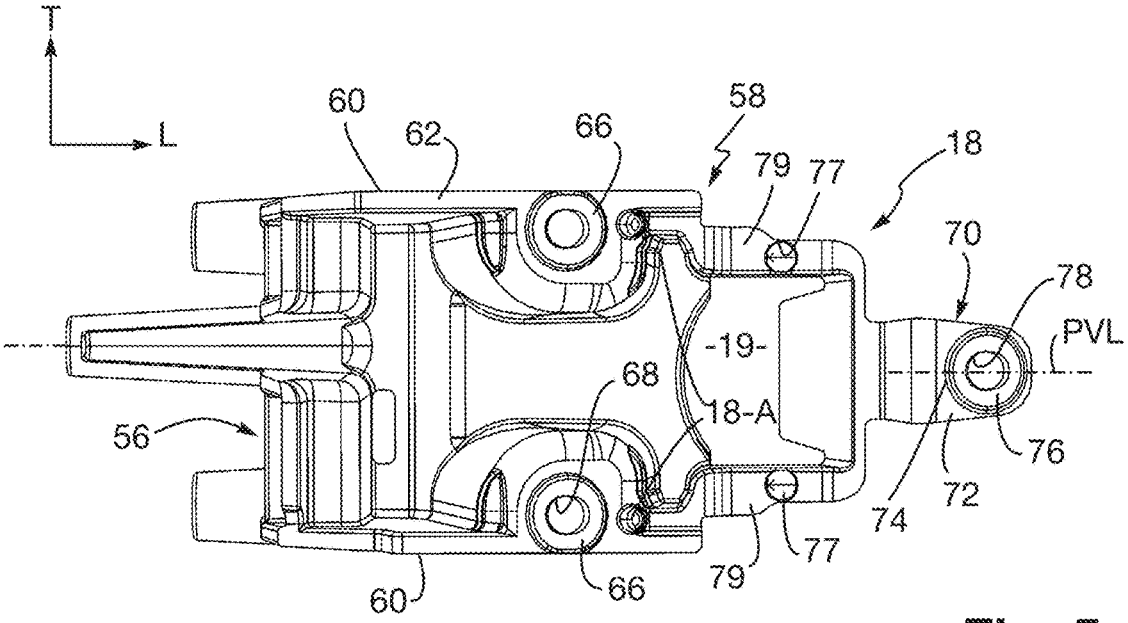
FIG. 5 is a bottom view of the single support shown in FIG. 4.

In the remainder of the description elements having an identical structure or analogous functions will be designated by the same references.

In the remainder of the description there will be used without limitation longitudinal, vertical and transverse orientations indicated by the trihedral "L,V,T" in the figures. A horizontal plane is also defined that extends longitudinally and transversely.

There has been shown in the figures an optical module 10 including, arranged vertically from the bottom upwards, a cooling block 12, a substrate 14, a collector 16 constituting the primary optical means, a single support 18, and a reflector 20 constituting the secondary optical means.

The optical module 10 and all of its components are of globally symmetrical design with respect to a vertical and longitudinal median plane PVL.

In known manner, the module is designed to emit light beams F axially toward the front (along the axis A corresponding to the longitudinal direction L indicated in the figures).

The Cooling Block

Here the cooling block 12 is a one-piece heatsink molded from a thermally conductive material. The cooling block 12 is delimited by a plane horizontal upper face 22 with a globally rectangular contour.

The upper face 22 of the cooling block 12 is delimited by two longitudinal lateral edges 24, a rear transverse edge 26 and a front transverse edge 28.

At its front end the cooling block 12 is extended beyond the front transverse edge 28 by a longitudinal fixing lug 30 that is delimited by a horizontal upper face 32 parallel to the upper face 22 but offset vertically downward relative to the latter.

The upper face 22 includes four position indexing studs 12-A that extend vertically upward, above the plane of the upper face 22.

In the vicinity of its rear edge 26 the upper face 22 includes in the corner a poka yoke finger 34.

In its upper face 22 the cooling block 12 includes two transversely opposed fixing holes 36 each of which is adapted to receive a rear fixing screw 38 of the support 18.

In its upper face 32 the lug 30 includes a central fixing hole 37 adapted to receive a front fixing and clamping screw 40 of the support 18.

In its upper face 22 the cooling block 12 includes two holes 12-B for indexing the position of the support 18.

Finally, in its front part and in its upper face 22 the cooling block 12 includes a series of three recesses 22B the function of which will be explained hereinafter.

The Substrate

Figure 7:
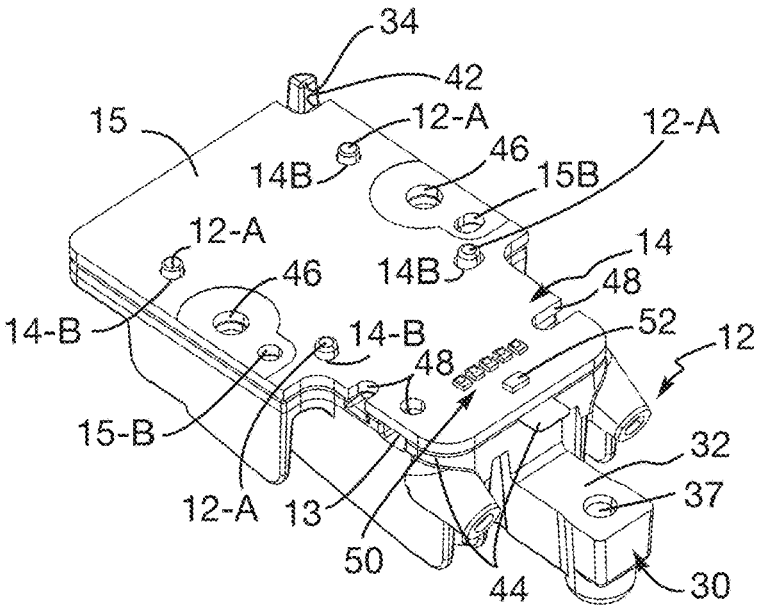
FIG. 7 is a view analogous to that of FIG. 6 after the primary optical collector and the electrical and electronic means controlling the supply of power to the light sources have been removed.
Figure 8:
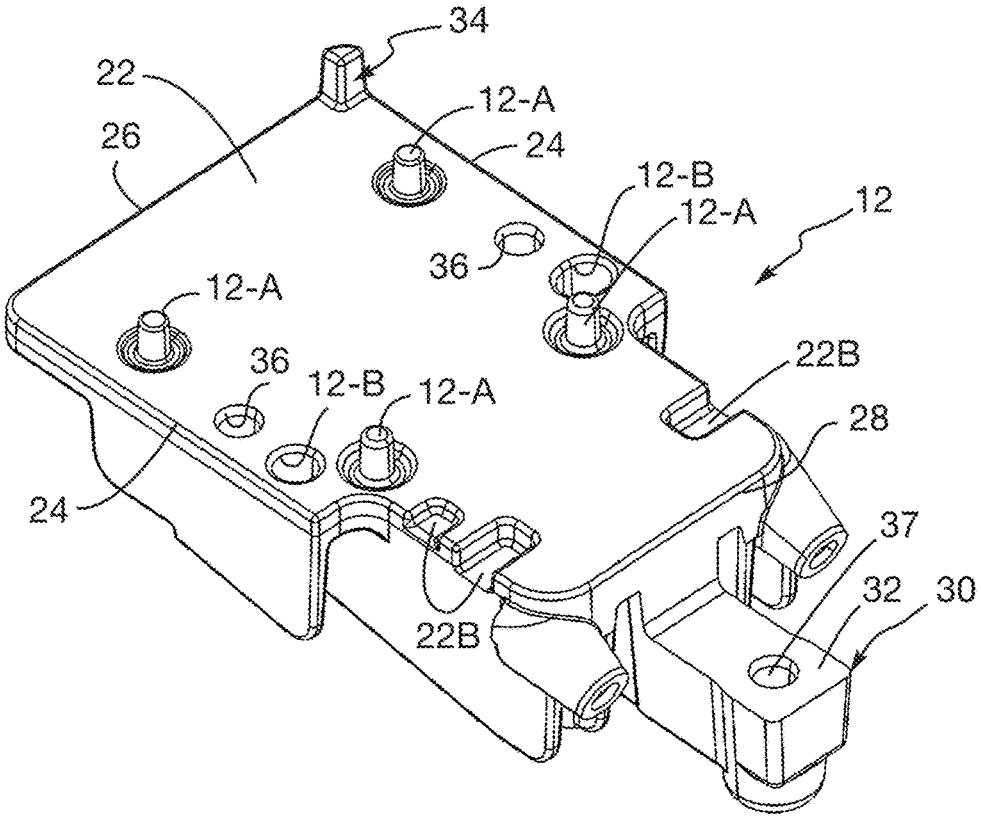
FIG. 8 is a view analogous to that of FIG. 7 that shows only the cooling block.
Figure 9:
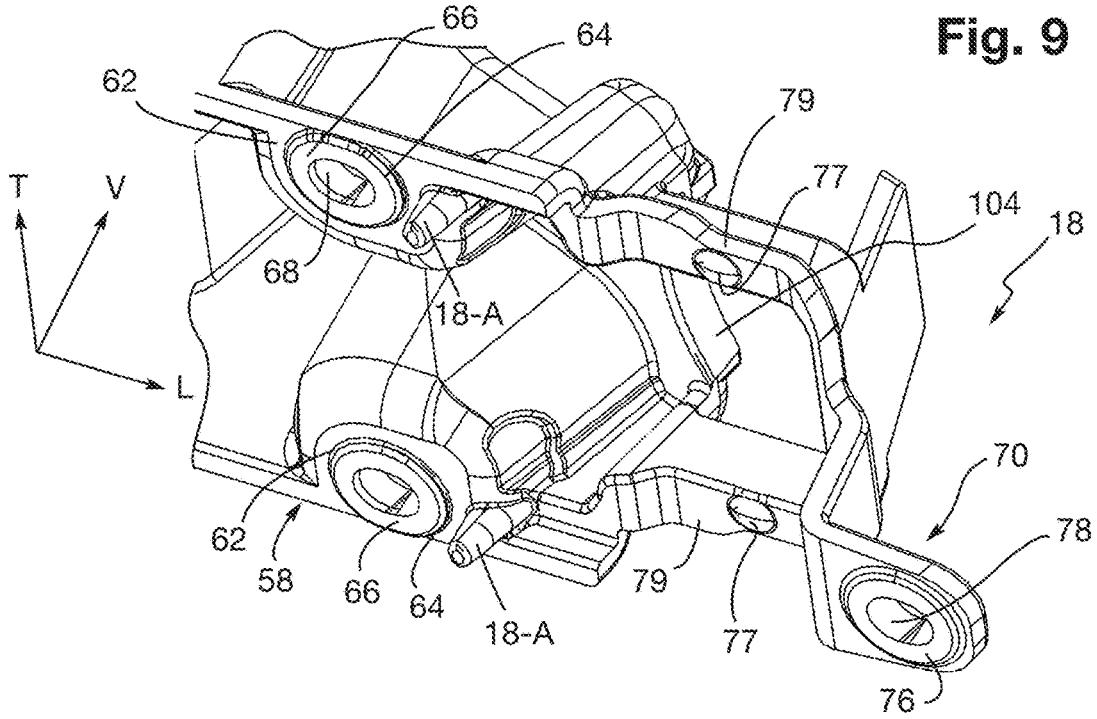
FIG. 9 is a perspective view from below and to a larger scale of the single support of the optical module shown in FIG. 4.
Figure 10:
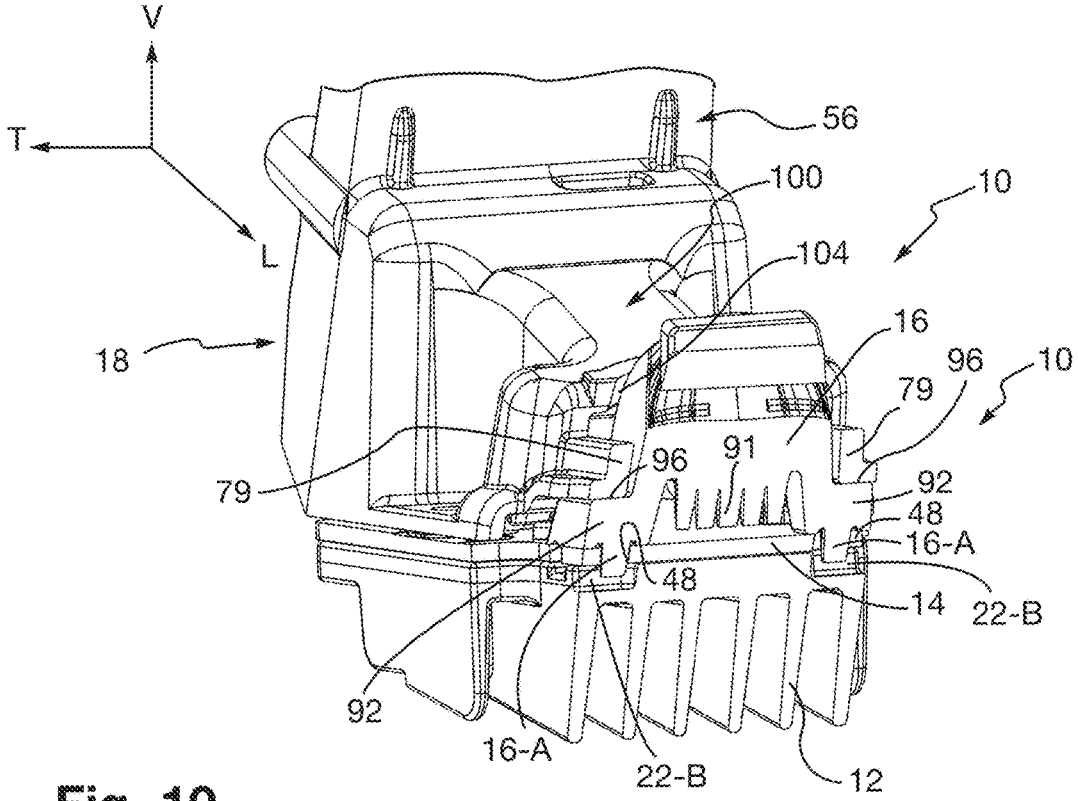
FIG. 10 is a perspective view in section on a transverse and vertical section plane indicated by the line 10-10 in FIG. 2.

As can be seen in FIG. 7 in particular, the substrate 14 is a horizontal plate with a rectangular contour virtually identical to that of the upper face 22 of the cooling block 12.

In the vicinity of its rear transverse edge the substrate 14 includes a notch 42 that receives the poka yoke finger 34.

The substrate 14 is delimited vertically by a horizontal lower face 13 that is adjacent the upper face 22 of the cooling block 12, here with a thermal conductivity foil 44 disposed between them.

The substrate 14 includes a series of through-holes including: four indexing holes 14-B complementary to the indexing fingers 12-A for the accurate positioning of the substrate 14 relative to the cooling block 12; two holes 46 aligned with the holes 36 for the rear fixing screws 38 to pass through; two indexing holes 15-B for positionally indexing the support 18; and three holes and notches 48 aligned with the recesses 22B.

In the vicinity of its front transverse edge the upper face 15 of the substrate 12 carries a series of five light sources 50 in the form of light-emitting diodes and a resistor 52. These components 50 and 52 are soldered to the upper face 15 of the substrate, which is a printed circuit board, for example.

Figure 6:
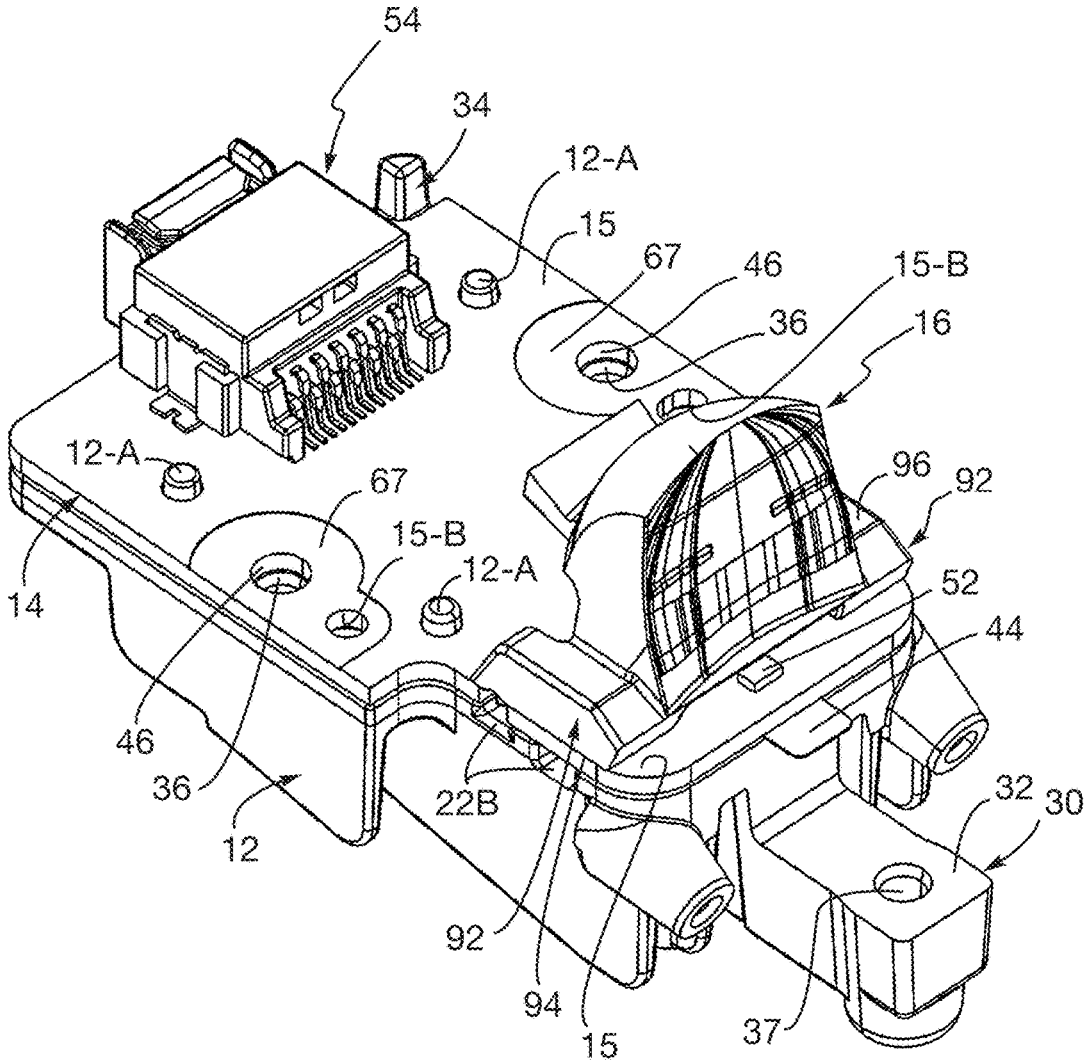
FIG. 6 is a view analogous to that of FIG. 1 after the secondary optical reflector and the single support have been removed.

As can be seen in FIGS. 3 and 6, in the vicinity of its rear transverse edge the upper face 15 of the substrate carries electrical and electronic components 54 for connecting the substrate 14 and the module 10 and for supplying power to and controlling the light sources 50.

The Single Support

The support 18 is a molded plastic material part that includes a vertical rear plate 56 for fixing the support 12, for example to a frame (not shown) enabling the mounting and fixing of a plurality of optical modules.

The support 18 also includes a globally horizontal lower part 58 that extends longitudinally toward the front from the lower portion of the rear plate 56.

The lower part 58 and a hollow part that is notably delimited by two lateral flanges 60.

The lower part 58 includes a lower face 62.

In its central part the lower face 62 includes two bearing rings 64 each of which delimits a plane annular bearing surface 66. The two bearing surfaces 66 are coplanar and are designed to bear vertically on facing annular portions 67 of the upper face 15 of the substrate 14.

Each bearing ring 64 has a central hole 68 through it for a fixing screw 38 to pass through.

When screwing the single support 18 to the cooling block 12 the head of each fixing screw 38 bears on a plane upper surface portion 70 around the hole 68.

In its lower 62, the horizontal lower part 58 of the support 18 includes two vertical indexing fingers 18-A each of which is designed to be received in a complementary indexing hole 15-B of the substrate 14 and then in an indexing hole 12-B of the cooling block 12 so as to position the support 18 accurately relative to the substrate 14 and the cooling block 12.

At its front part the horizontal lower part 58 of the support 18 includes a fixing and clamping lug 70 with an L-shaped profile that extends vertically downward and then horizontally forward.

The lower face 72 of the lug 70 includes a bearing ring 74 that delimits a plane annular bearing surface 76.

The bearing ring 74 is designed to come to bear on a corresponding portion of the upper face 32 of the front lug 30.

The bearing ring 74 has a central hole 78 through it for the fixing screw 40 to pass through.

The design and the dimensions of the fixing lug 70 are such that it is elastically deformable during fixing and clamping operations by means of the screw 40 the head of which bears on a plane upper surface portion 80 around the hole 78.

In its front part, between the indexing fingers 18-A and the fixing lug 70, the lower face 62 of the support 18 includes two studs 77 projecting vertically downward and having a profile in the shape of a convex spherical dome and each of which is designed to cooperate with a corresponding portion of the collector 16 as will be explained hereinafter.

Each stud 77 is formed on a longitudinal branch of 79 that is stiffened by an upper rib.

At its upper free end the rear fixing plate 56 includes a series of three indexing fingers 56-A that extend vertically upward and a fixing hole 82 surrounded by a bearing surface 84 for mounting and fixing the reflector 20. Of the three indexing fingers, the "central finger provides a poka yoke function for the correct positioning of the reflector 20.

In its front part the horizontal lower plate 58 of the support 18 includes a principal opening 19 allowing the upper part of the collector 16 to pass through.

In its central part, substantially adjacent the upper part of the collector 16, the support 18 includes an enlargement 100 that includes an upper wall 102 that is delimited by a front concave circular edge 104.

The wall 102 is a protecting wall to prevent the phenomenon known as "sunburn". This phenomenon is the result, in certain situations, of the accidental penetration of solar radiation into the interior of the optical module by reflection at the reflecting front face 21 of the reflector 20 and then through the collector 16 to cause a phenomenon of local heating harmful to the light-emitting diodes 50, which can lead to their destruction. The wall 102 enables defocusing of the beam resulting from the solar radiation relative to the support 18.

The Collector

Figure 11:
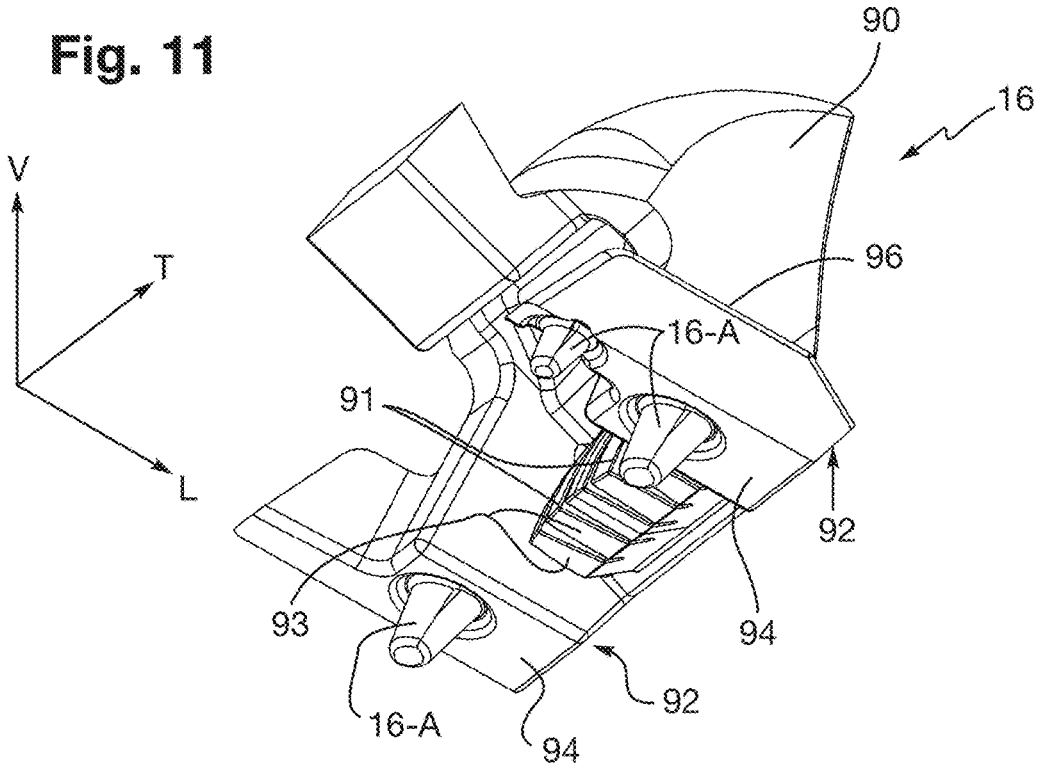
FIG. 11 is a perspective view from below of the primary collector.
Figure 12:
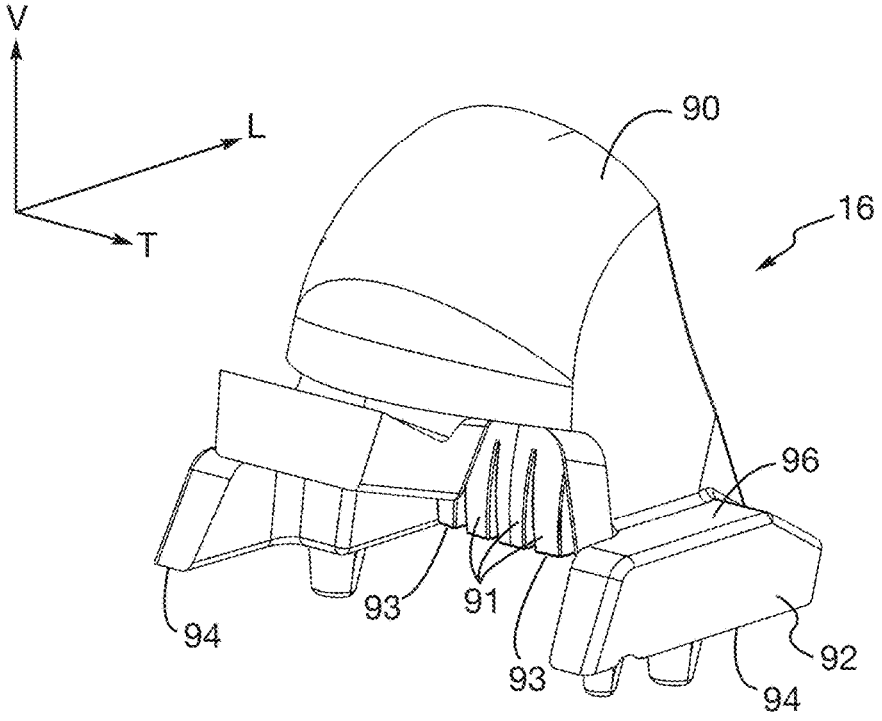
FIG. 12 is a perspective view of the primary collector from FIG. 11 viewed from a different angle.

In known manner the collector 16 that is shown in detail in FIGS. 11 and 12 is a molded plastic material part that includes an upper part 90 for guiding and converting the light rays emitted by the light-emitting diodes 50 and that extends through the principal opening 19 of the support 18:

The collector 16 includes at the bottom a fixing base that here consists of two lateral blocks 92 each of which is delimited by a plane lower bearing face 94. The two plane bearing surfaces 94 are designed to come to bear vertically downward on facing portions of the upper face 15 of the substrate 14 located at the level of the openings 22-B and the holes and notches 48.

The lateral blocks 92 carry three vertical indexing fingers 16-A that extend downward and are designed to cooperate in complementary manner with the indexing holes and notches 48 of the substrate 14.

Thus the collector 16 can be positionally indexed with a poka yoke function relative to the substrate 14, the support 18, and the cooling block 12.

The accurate positional indexing of the collector 16 relative to the substrate 14 is important to guarantee good positioning of the collector 16 relative to the light-emitting diodes 50.

In effect, in its lower part the collector 16 includes a series of light guides 91 each of which is delimited at the bottom by a facet 93 that constitutes the entry surface into the collector 16 of the light emitted by the light-emitting diode 50 arranged facing the facet 93.

Each lateral block 92 is delimited at the top by a plane surface portion 96.

In the mounted and assembled position of the collector 16 and the support 18 each lateral block 92 is accommodated inside a branch of 79 of the support 18 and each plane surface portion 96 constitutes a bearing surface for an associated stud 77 that exerts a localized vertically downward bearing force to press the collector 16 onto the upper face 15 of the substrate 14.

The fixing and clamping of all the components 12, 14, 16 and 18 is effected by stacking these components with their relative positional indexing and then by fixing by screwing by means of the rear fixing screws 38 and the front fixing screw 40.

Because of the elastically deformable design of the fixing lug 70, during the screwing and axial clamping of the screw 40, the lug 70 is elastically deformed to exert continuously a clamping force to press each lateral block 92 of the collector 16 onto the upper face 15 of the substrate 14.

The Reflector

The reflector is a molded plastic material part that is positionally indexed and fixed to the support 18, to be more precise to the upper part of the rear plate 56 of the support 18.

For positioning it and fixing it to the support 18 the reflector 20 includes a rear horizontal upper lug 86 that includes three complementary indexing holes 86-B.

As seen in FIGS. 1 to 3 in particular, in the mounted and fixed position, the indexing fingers 56-A are received in the indexing holes 86-B and the fixing lug 56 is mounted and clamped to bear vertically on the bearing surface 84 by a fixing screw 88.

The reflector 20 is therefore positionally indexed on the support 18 and indirectly relative to the collector 16.

The invention claimed is:

1. Motor vehicle optical module for emitting at least two light-emitting segments that can be activated selectively, the module including:

a substrate;

at least two light sources mounted on the substrate each of which can be activated selectively to emit light rays;

a primary optical component adapted to form primary light beams from the light rays emitted by each light source;

a secondary optical component adapted to project each of the primary light beams to form said light-emitting segments; and a single support that carries the substrate, the primary optical component and the secondary optical component, wherein the single support includes a bearing surface to position the secondary optical component relative to the substrate.

2. Optical module according to claim 1, wherein the primary optical component:

includes position indexing fingers that cooperate with complementary portions of the substrate; and is fixed in an indexed position by clamping the primary optical component between the support and the substrate.

3. Optical module according to claim 1, wherein the secondary optical component:

includes position indexing fingers that cooperate with complementary portions of the support; and is fixed to the support.

4. Optical module according to claim 1, wherein the module includes a cooling block that is adjacent to the substrate.

5. Optical module according to claim 4, wherein the cooling block includes position indexing fingers that cooperate with complementary portions of the substrate.

6. Optical module according to claim 5, wherein the substrate is fixed by clamping the substrate between the cooling block and the support.

7. Optical module according to claim 6, wherein the support is fixed to the cooling block by clamping screws.

8. Optical module according to claim 6, wherein the substrate is a horizontal plate that is disposed vertically between an upper face of the cooling block and a lower bearing plane on the support.

9. Optical module according to claim 5, wherein the support is fixed to the cooling block by clamping screws.

10. Optical module according to claim 5, wherein the substrate is a horizontal plate that is disposed vertically between an upper face of the cooling block and a lower bearing plane on the support.

11. Optical module according to claim 4, wherein the support is fixed to the cooling block by clamping screws.

12. Optical module according to claim 11, wherein the substrate is a horizontal plate that is disposed vertically between an upper face of the cooling block and a lower bearing plane on the support.

13. Optical module according to claim 4, wherein the support includes at least two lower bearing areas delimiting the bearing surface on an upper face of the substrate and includes an elastically deformable lug that is fixed to the cooling block to clamp the primary optical component between the support and the substrate.

14. Optical module according to claim 13, wherein the primary optical component includes:

a lower bearing face that cooperates with the upper face of the substrate;

and at least one upper clamping face on which said elastically deformable lug of the support acts.

15. Motor vehicle optical module for emitting at least two light-emitting segments that can be activated selectively, the module including:

a substrate;

at least two light sources mounted on the substrate each of which can be activated selectively to emit light rays;

a primary optical component adapted to form primary light beams from the light rays emitted by each light source;

a secondary optical component adapted to project each of the primary light beams to form said light-emitting segments; and a single support that carries the substrate, the primary optical component and the secondary optical component, wherein the single support includes a bearing surface to position the secondary optical component relative to the substrate, and the substrate is a horizontal plate that is disposed vertically between an upper face of a cooling block and the bearing surface on the support.

* * * * *